United States Patent [19]

Haddad et al.

[11] Patent Number: 4,789,458

[45] Date of Patent: Dec. 6, 1988

[54] FLUID CATALYTIC CRACKING WITH PLURALITY OF CATALYST STRIPPING ZONES

[75] Inventors: James H. Haddad, Princeton Junction; Hartley Owen, Belle Mead; Klaus W. Schatz, Skillman, all of N.J.

[73] Assignee: Mobil Oil Corporation, New York, N.Y.

[21] Appl. No.: 63,713

[22] Filed: Jun. 15, 1987

Related U.S. Application Data

[63] Continuation of Ser. No. 818,625, Jan. 14, 1986, abandoned, which is a continuation-in-part of Ser. No. 686,800, Dec. 27, 1984, abandoned.

[51] Int. Cl.[4] ..... C10G 11/18

[52] U.S. Cl. ..... 208/151; 208/164; 208/159; 502/34

[58] Field of Search ..... 208/113, 150, 151, 159, 208/161, 164; 422/144; 502/40, 34

[56] References Cited

U.S. PATENT DOCUMENTS

| | | | |
|---|---|---|---|
| 2,526,881 | 5/1948 | Kunreuther et al. | 196/52 |
| 2,944,963 | 3/1958 | Wilson | 208/149 |
| 3,008,896 | 11/1961 | Lawson | 208/74 |
| 3,152,066 | 10/1964 | Wickham | 208/163 |
| 3,197,399 | 7/1965 | Wight | 208/111 |
| 3,261,776 | 7/1966 | Baumann et al. | 208/113 |
| 3,687,841 | 8/1972 | Saxton et al. | 422/214 |
| 3,821,103 | 6/1974 | Owen et al. | 208/72 |
| 3,926,778 | 12/1975 | Owen et al. | 207/74 |
| 4,219,442 | 8/1980 | Vickers | 252/417 |
| 4,243,517 | 1/1981 | Luckenbagh | 208/164 |
| 4,272,402 | 6/1981 | Mayes | 422/144 |
| 4,331,533 | 5/1982 | Dean et al. | 208/113 |
| 4,336,160 | 6/1982 | Dean et al. | 252/417 |
| 4,404,095 | 9/1983 | Haddad et al. | 208/161 |
| 4,419,221 | 12/1983 | Castagnos, Jr. et al. | 208/113 |
| 4,422,925 | 12/1983 | Williams et al. | 208/75 |
| 4,424,116 | 1/1984 | Hettinger, Jr. | 208/120 |
| 4,427,537 | 1/1984 | Dean et al. | 208/120 |
| 4,435,281 | 3/1984 | Vasalos | 208/113 |
| 4,444,722 | 4/1984 | Owen | 422/144 |
| 4,464,250 | 8/1984 | Myers et al. | 208/120 |
| 4,478,708 | 10/1984 | Farnsworth | 208/161 |
| 4,481,103 | 11/1984 | Krambeck et al. | 208/120 |
| 4,502,947 | 3/1985 | Haddad et al. | 208/161 |
| 4,514,285 | 4/1985 | Niccum et al. | 208/148 |
| 4,605,491 | 8/1986 | Haddad et al. | 208/161 |

*Primary Examiner*—Olik Chaudhuri

*Attorney, Agent, or Firm*—Alexander J. McKillop; Michael G. Gilman; Richard D. Stone

[57] ABSTRACT

A fluid catalytic cracking (FCC) process and apparatus is described which includes a high temperature stripper (hot stripper) to control the carbon level, hydrogen level, and sulfur level on spent catalyst, followed by single or multi-stage regeneration. The high temperature stripper may operate at a temperature between 100° F. above the temperature of a catalyst hydrocarbon mixture exiting a riser and 1500° F. The regenerator may operate at a temperature between 100° F. above that of the catalyst in the hot stripper and 1600° F. Hot regenerated catalyst recycles to the hot stripper to maintain the hot stripper temperature. The present invention has the advantage that it separates hydrogen from catalyst to eliminate hydrothermal degradation, and separates sulfur from catalyst as hydrogen sulfide and mercaptans which are easy to scrub. The present invention also provides a method and apparatus for converting a TCC unit to a FCC unit, with maximum use of the TCC unit.

28 Claims, 1 Drawing Sheets

FLUID CATALYTIC CRACKING WITH PLURALITY OF CATALYST STRIPPING ZONES

CROSS REFERENCE TO RELATED APPLICATION

This is a continuation of copending application Ser. No. 818,625, filed on Jan. 14, 1986 now abandoned, which is a continuation-in-part application of Ser. No. 686,800, filed Dec. 27, 1984, now abandoned.

BACKGROUND OF THE INVENTION

1. Field of the Invention

This invention relates to methods and apparatus for fluid catalytic cracking of hydrocarbon products with subsequent regeneration of catalyst particles, and more particularly, to methods and apparatus for fluid catalytic cracking employing a short contact time riser conversion zone, a separator for separating spent catalyst from a hydrocarbon stream, a high temperature stripper to control carbon level on spent catalyst, means for regenerating the catalyst after high temperature stripping, and means for returning regenerated catalyst to the riser conversion zone and the high temperature stripper.

2. Discussion of the Prior Art

The field of catalytic cracking has undergone progressive development since 1940. The trend of development of the fluid catalytic cracking process has been to all riser cracking, use of zeolite-containing catalysts and heat balanced operation.

Fluid catalytic conversion systems require a combined operation including separation of finely divided fluidizable catalyst particles from gasiform reaction products and regeneration of the catalyst employed therein by burning to remove deactivating carbonaceous deposits. Further, in present riser catalytic cracking operations, large amounts of catalyst are suspended in gasiform materials in the riser catalytic cracking units. It is necessary to separate rapidly the suspensions into a catalyst phase and a gasiform phase after the suspension conversion operation has traversed the riser unit or conversion zone. Various attempts have been made to provide improved suspension separation techniques to decrease losses in the catalyst phase or the gasiform phase resulting from overextending the conversion reactions.

Multistage stripping is already known in the prior art, as disclosed, for example, in U.S. Pat. No. 4,043,899 to Anderson et al. In addition, a catalyst terminating in an enclosed cylindrical vessel within a FCC reactor vessel and a riser containing baffles is disclosed by U.S. Pat. No. 4,206,174 to Heffley et al and risers attached to conduits are disclosed by U.S. Pat. No. 4,219,407 to Haddad et al.

Other major trends in fluid catalytic cracking processing have been modifications to the process to permit it to accommodate a wider range of feedstocks, in particular, stocks that contain more metals and sulfur than had previously been permitted in the feed to a fluid catalytic cracking unit.

Along with the development of process modifications and catalysts, which could accommodate these heavier, dirtier feeds, there has been a growing concern about the amount of sulfur contained in the feed that ended up as $SO_x$ in the regenerator flue gas. Higher sulfur levels in the feed, combined with a more complete regenerator, tended to increase the amount of $SO_x$ contained in the regenerator flue gas. Some attempts have been made to minimize the amount of $SO_x$ discharged to the atmosphere through the flue gas by providing agents to react with the $SO_x$ in the flue gas. These agents pass along with the regenerated catalyst back to the fluid catalytic cracking reactor, and then the reducing atmosphere releases the sulfur compounds as $H_2S$. Suitable agents for this purpose have been described in U.S. Pat Nos. 4,071,436 and 3,834,031. Use of a cerium oxide agent is shown in U.S. Pat. No. 4,001,375.

Unfortunately, the conditions in most fluid catalytic cracking regenerators are not the best for $SO_x$ adsorption. The high temperatures encountered in modern fluid catalytic cracking regenerators (up to 1600° F.) tend to discourage $SO_x$ adsorption. One approach to overcome the problem of $SO_x$ in flue gas is to pass catalyst from a fluid catalytic cracking reactor to a long residence time steam stripper. After the long residence time steam stripping, the catalyst passes to the regenerator, as disclosed in U.S. Pat. No. 4,481,103 to Krambeck et al and incorporated herein by reference. However, the process described in U.S. Pat. No. 4,481,103 preferably steam strips spent catalyst at 932° to 1022° F. (500°-550° C.), which may not be sufficient to remove some undesirable sulfur- or hydrogen-containing components. Furthermore, catalyst passing from a fluid catalytic cracking stripper to a fluid catalytic cracking regenerator contains hydrogen-containing components, such as coke, adhering thereto. This causes hydrothermal degradation when the hydrogen reacts with oxygen in the regenerator to form water.

U.S. Pat. No. 4,336,160 to Dean et al attempts to reduce hydrothermal degradation by staged regeneration. However, in this process, the flue gas from both stages of regeneration contains $SO_x$, which is difficult to clean.

It would be desirable to separate hydrogen from catalyst to eliminate hydrothermal degradation. It would be further advantageous to remove sulfur-containing compounds prior to regeneration to prevent $SO_x$ from passing into the regenerator flue gas.

SUMMARY OF THE INVENTION

It is one object of the present invention to provide an improved fluid catalytic cracking process and apparatus employing regenerated catalyst to provide heat to a catalyst stripping stage.

It is another object to provide a process and apparatus which decreases overcracking of conversion products to increase desired products yield.

It is another object to improve separation of catalyst from hydrocarbon products by controlling hydrogen level, carbon level, and sulfur level on spent catalyst to improve subsequent catalyst regeneration operations which remove deactivating coke deposits from stripped catalysts.

It is another object of the invention to provide a fluid catalytic cracking process and apparatus for maintaining a hot stripper at a temperature greater than that at which a catalyst-hydrocarbon mixture is discharged from a riser conversion zone by mixing hot regenerated catalyst into the hot stripper.

It is another object to eliminate hydrothermal degradation, decrease coke load in the regeneration system and to decrease environmental $SO_2$ and $SO_3$ from the regeneration system.

It is another object to employ multi-stage stripping to improve the stripping of the hydrocarbon entrained in the catalyst.

It is another object to provide a method and apparatus for adapting TCC systems to FCC operation.

It is another object of this invention to provide a process and apparatus wherein a hot stripping vessel is located below a regenerator vessel.

It is another object to provide a hot stripper which employs first and second stripping gas streams, whereby the second stripping gas stream displaces the first stripping gas stream away from the catalyst.

In its process respects, the present invention provides a process for fluid catalytic cracking of a feedstock containing hydrocarbons, in which a mixture comprising catalyst and the feedstock passes upwardly through a riser conversion zone under fluid catalytic cracking conditions to crack the feedstock. The mixture discharges, at discharge temperature, from the riser and a first portion of catalyst is separated from the mixture, with the remainder of the mixture forming a gaseous effluent stream. The separated catalyst portion is heated by combining the first separated catalyst portion with a first portion of regenerated catalyst from a fluid catalytic cracking regenerator vessel to form combined catalyst. The first portion of regenerated catalyst is gravity fed into a hot stripping zone, where the combined catalyst is hot stripped by contact with a first stripping gas stream in the hot stripping zone to form hot stripped catalyst, at a hot stripping temperature between 100° F. (56° C.) above the discharge temperature and 1500° F. (816° C.) the first regenerated catalyst portion having a temperature between 100° F. (56° C.) above the hot stripping temperature and 1600° F. (871° C.) prior to heating the separated catalyst. The hot stripped catalyst is regenerated in a fluid catalytic cracking regenerator vessel by contact with an oxygen-containing stream at fluid catalytic cracking regeneration conditions, comprising a temperature in the range from 100° F. (56° C.) above that of the hot stripping temperature to 1600° F. (871° C.).

In its apparatus respects, the present invention provides an apparatus for fluid catalytic cracking feedstock comprising hydrocarbons, including means defining a riser conversion zone through which a mixture comprising catalyst and feedstock passes upwardly at fluid catalytic cracking conditions to crack the feedstock, means for discharging the mixture from the riser conversion zone, the mixture having a riser discharge temperature as it discharges from the riser conversion zone, means for separating a first portion of catalyst from the mixture, with the remainder of the mixture forming a gaseous effluent stream, means for heating the separated catalyst portion, comprising means for contacting said combined catalyst with a first stripping gas stream to form a hot stripped catalyst stream, means for gravity feeding said first portion of regenerated catalyst into said means for hot stripping, and a fluid catalytic cracking regenerator vessel for producing the first portion of regenerated catalyst.

Preferably, the regenerated catalyst portion is maintained at a temperature in the range between 150° F. (83° C.) above the temperature of catalyst in a stripping vessel, and the catalyst in the stripping vessel is maintained at a temperature between 150° F. (83° C.) above the riser discharge temperature and 1400° F. (760° C.). The residence time of gas within said hot stripping zone preferably ranges between 0.5 and 5 seconds.

Also according to the present invention, a process is provided of fluid catalytic cracking of a suspension of hydrocarbon reactant and catalyst in a riser conversion zone and subsequently regenerating catalyst recovered from the riser conversion zone to heat the catalyst in order to remove carbonaceous deposits before returning to the riser conversion zone. The process includes the steps of introducing hydrocarbon feed and catalyst into an upstream end of a riser conversion zone to yield a gasiform mixture of catalyst and cracked hydrocarbons exiting a downstream end of the riser conversion zone, and deflecting catalyst in the gasiform mixture exiting the downstream end of the riser conversion zone downwardly to a primary stripping zone to separate a major portion of the catalyst from the cracked hydrocarbons. The process further includes contacting the downwardly deflected catalyst with a stripping medium introduced into the primary stripping zone to separate the catalyst from hydrocarbon particles entrained therein, and separating in a cyclone separator a portion of the catalyst, which was not deflected downwardly in the deflection step, from the cracked hydrocarbons. The process also includes introducing stripped catalyst from the primary stripping zone and catalyst from a dipleg associated with the cyclone separator into a secondary stripping zone, passing stripped catalyst from the secondary stripping zone into a first stage regenerator, introducing regenerated catalyst output from the first stage regenerator into a second stage regenerator, and recycling hot regenerated catalyst from the second stage regenerator back into the secondary stripping zone.

The catalyst from the primary stripper, the catalyst from the cyclone dipleg and the hot regenerated catalyst from the second stage regenerator can be mixed prior to being introduced into the secondary stripping zone. A mixture, e.g., a mixing tray, can be provided between the primary stripper and the secondary stripper for mixing catalyst from the primary stripper, catalyst from the cyclone dipleg and hot regenerated catalyst from the second stage regenerator prior to this catalyst mixture being introduced into the secondary stripping zone. The first stage regenerator can be a fast fluidized bed regenerator. The process can further include removing fines from a catalyst bed in the second stage regenerator using a cyclone comprising a primary cyclone and a secondary cyclone, with the secondary cyclone including a secondary dipleg for removing catalyst fines. The method can also include introducing a stripping medium into the secondary stripping zone to contact catalyst therein to separate the catalyst particles from hydrocarbon entrained therein, and introducing hot regenerated catalyst from the second stage regenerator into the upstream end of the riser conversion zone.

Also, according to the present invention, an apparatus is provided for fluid catalytic cracking which includes a riser conversion zone comprising a vertically elongate tubular conduit and means for introducing hydrocarbon feed and catalyst into an upstream end of the riser conversion zone to yield a gasiform mixture of catalyst and cracked hydrocarbons at a downstream end of the riser conversion zone. A deflector is disposed at the downstream end of the riser conversion zone for deflecting catalyst in the gasiform mixture downwardly to separate a portion of the catalyst from the cracked hydrocarbons. The apparatus further comprises a primary stripper for receiving the downwardly deflected catalyst. The primary stripper includes a conduit for introducing a stripping medium to contact the downwardly deflected catalyst to separate the catalyst from hydrocarbon entrained therein. The apparatus also includes a secondary stripper for receiving catalyst from the primary stripper, with the secondary stripper including means for causing a stripping medium to contact the catalyst to separate the catalyst from the hydrocarbon entrained therein. A regenerator is provided which includes first and second stages. The first stage comprises a regenerator for regenerating stripped catalyst introduced therein from the secondary stripper and for introducing regenerated catalyst output into the second stage regenerator. The second stage regenerator includes a first recycle conduit introducing hot regenerated catalyst into the secondary stripper, and a second recycling means cooperating with the conduit for introducing hydrocarbon feed and catalyst, for introducing hot regenerated catalyst into the upstream end of the riser conversion zone. The apparatus further includes at least one cyclone connected to at least one external conduit providing an exit adjacent the downstream end of the riser conversion zone for vaporous hydrocarbon product, catalyst and the stripping medium introduced into the primary and secondary strippers. The cyclone includes a conduit for conducting vaporous hydrocarbon product, stripping medium and unseparated catalyst to a region outside the cyclone. The cyclone separates a portion of the catalyst entering therein and directs it through a cyclone dipleg to the secondary stripper. Accordingly, the secondary stripper receives stripped catalyst from the primary stripper, catalyst from the dipleg associated with the cyclone and hot regenerated catalyst from the second stage regenerator.

The apparatus can further include a mixer, e.g., a mixing tray disposed between the primary stripper and the secondary stripper for mixing stripped catalyst from the primary stripper, catalyst from the dipleg associated with the cyclone means and hot regenerated catalyst from the second stage regenerator prior to passage of the mixed catalyst into the secondary stripper. The first stage regenerator can comprise a fast fluidized bed regenerator. The second stage regenerator can include a second cyclone, including a primary cyclone and a secondary cyclone, with the secondary cyclone including a secondary dipleg for fines removal from a catalyst bed associated with the second stage regenerator. The riser conversion zone can terminate within an elongated enclosed vessel, having a substantially continuous sidewall attached to a bottom member and a top member, with the deflector comprising the top member of the vessel. An upper portion of the vessel comprises the primary stripper and a lower portion of the vessel comprises the secondary stripper. The mixing tray can be disposed in an intermediate portion of the stripper at a bottom region of the primary stripper.

The present invention strips at a temperature higher than the riser exit temperature to separate hydrogen, as molecular hydrogen or hydrocarbons from the coke which adheres to catalyst, to eliminate hydrothermal degradation, which typically occurs when hydrogen reacts with oxygen in a fluid catalytic cracking regenerator to form water. The high temperature stripper (hot stripper) also removes sulfur from coked catalyst as hydrogen sulfide and mercaptans, which are easy to scrub. In contrast, removing sulfur from coked catalyst in a regenerator produces $SO_x$, which passes into the regenerator flue gas and is more difficult to scrub. Furthermore, the high temperature stripper removes additional valuable hydrocarbon products to prevent burning these hydrocarbons in the regenerator. An additional advantage of the high temperature stripper is that it quickly separates hydrocarbons from catalyst. If catalyst contacts hydrocarbons for too long a time at a temperature greater than or equal to 1000° F. (538° C.), then diolefins are produced, and the diolefins are undesirable for downstream processing, such as alkylation. However, the present invention allows a precisely controlled, short contact time at 1000° F. (538° C.) or greater to produce premium, unleaded gasoline with high selectivity.

BRIEF DESCRIPTION OF THE DRAWINGS

The above and other objects, advantages and features of the present invention will be more fully understood when considered in conjunction with the following drawings, of which.

DETAILED DESCRIPTION OF THE INVENTION

Figure 1:
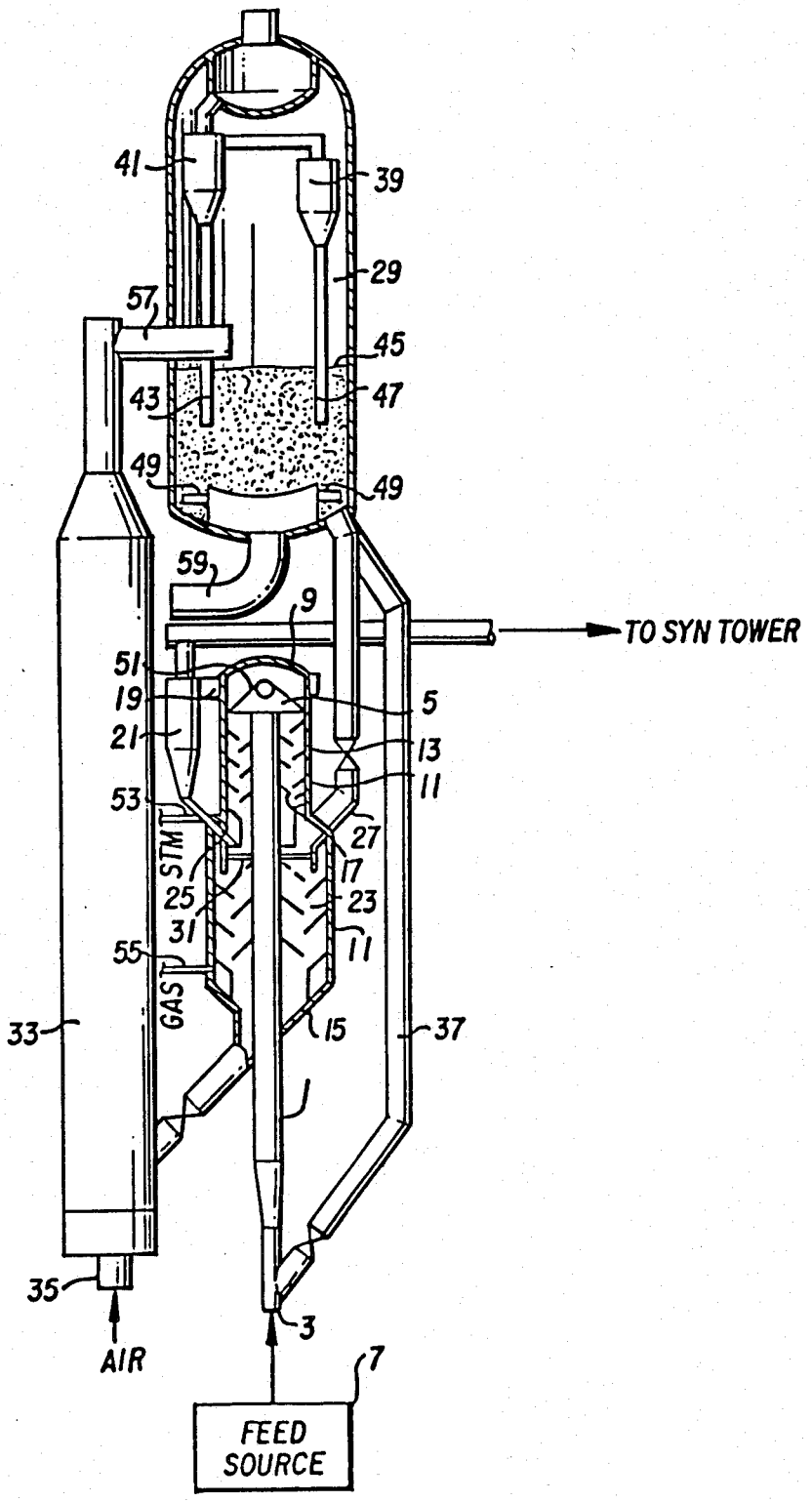
FIG. 1 illustrates a fluid catalytic cracking reactor-regenerator system according to the present invention.

FIG. 1 shows a first embodiment of a fluid catalytic conversion reactor-regenerator system of the present invention including a reactor (riser) conversion zone formed of a vertically elongate tubular conduit 1 having an upstream end 3 wherein hydrocarbon feed from feed source 7 and catalyst from conduit 37 carrying hot regenerated catalyst from second stage regenerator 29 are introduced and a downstream end 5 where a gasiform mixture of catalyst and cracked hydrocarbons exit riser conversion zone conduit 1. The riser conversion zone is preferably a short contact time riser reactor of the type having a multiple feed nozzle and an acceleration zone. At downstream end 5 of riser conversion zone conduit 1, catalyst in the gasiform mixture exiting conduit 1 is deflected downwardly by, e.g., inertial separator 51, to separate a major portion of the catalyst from the cracked hydrocarbons. The mixture exits the conduit 1 at any suitable temperature, but preferably the mixture exits the conduit 1 at a temperature between 900° and 1100° F., most preferably between 1000° and 1050° F. The riser conversion zone terminates within elongated enclosed vessel 11, which has a substantially continuous sidewall 13 attached to bottom member 15 and top member 9 which can function with deflection means 51 to deflect catalyst in the gasiform mixture exiting riser conduit 1 to separate a portion of the catalyst from the cracked hydrocarbons. One or more perpendicular conduits 19 provide an exit from vessel 11 for the gasiform mixture of vaporous hydrocarbon product and a portion of the catalyst which was not deflected downwardly by the deflection means. Also, stripping medium from the stripping regions 17 and 23 exits vessel 11 via conduits 19. Deflection can also be accomplished by means of an inertial separator or deflection means of the type disclosed in copending U.S. patent application Ser. No. 663,104 by Owen et al, filed Oct. 22, 1984, and incorporated herein by reference.

Vessel 11 includes a stripping zone including a primary stripping region 17 and a secondary stripping region 23. Primary stripping region 17 is formed in an upper portion of vessel 11 and initially receives the downwardly deflected catalyst. A stripping medium is introduced into primary stripper 17 via line 53 to contact the downwardly deflected catalyst to separate the catalyst from hydrocarbon entrained therein. The separated hydrocarbons ascend with the stripping medium to exit vessel 11 through conduits 19 connected to external closed cyclone system 21 and then onto a well-known synthetic crude separation tower (not shown). Secondary stripping region 23 is formed in a lower portion of vessel 11 and receives stripped catalyst from primary stripper 17, stripped catalyst from one or more diplegs 25 associated with cyclone system 21 and hot regenerated catalyst along conduit 27 which is connected to a bottom portion of second stage regenerator 29. Therefore, the secondary region 23 is a hot stripping zone because the recycle of hot regenerated catalyst directly to the region 23 allows the catalyst within region 23 to be at a temperature greater than that at which it is discharged from the riser 1. Preferably, the catalyst in region 23 is at a temperature between 100° F. above that at which it exits the riser 1 and 1600° F. Most preferably, the catalyst in the region 23 is at a temperature between 150° F. above that at which it exits the riser 1 and 1600° F.

Mixing means, in a form of mixing tray 31, is disposed between primary stripper 17 and secondary stripper 23 for mixing stripped catalyst from second stage regenerator 29, prior to passage of this mixed catalyst into secondary stripper 23. A stripping medium is introduced into secondary stripper 23 via line 55 to separate additional entrained hydrocarbon from the catalyst. This latter stripping medium can be light hydrocarbon gas, inert gas or steam, but is preferably inert gas or steam. The secondary stripper 23 can be provided with multiple stripping gas conduits, such as stripping gas conduits 146A, 146B, 146C, into injection points 147, 148, 149 of FIGS. 2 and 3. Conduit 146A preferably passes molecular nitrogen, molecular hydrogen, methane, ethane, propane or mixtures thereof into a hot stripping zone 143. Conduit 146C preferably passes molecular nitrogen, steam or mixtures thereof into hot zone 143. The nitrogen and steam are fed to a lower portion of the hot stripping zone 143 to prevent hydrothermal degradation due to passing hydrogen or hydrocarbon containing gas into a regenerator riser 160. Conduit 146B may pass any type stripping gas therethrough. Hot regenerated catalyst from second stage regenerator 29 is recycled to mixing tray 31 and then into secondary stripping region 23, in order to provide more complete removal of hydrocarbons from the spent catalyst.

First stage regenerator 33, which is preferably a fast fluidized bed regenerator, receives stripped catalyst leaving secondary stripper 23 to burn off additionally entrained coke deposits by contact with a rapidly ascending stream of air at, e.g., 4 to 20 ft/sec, which is provided via air inlet 35. First stage regenerator 33 passes regenerated catalyst output into second stage regenerator 29 via conduit 57. Second stage regenerator 29 includes a first conduit 27 for recycling hot regenerated catalyst by gravity feed onto mixing tray 31, and then to secondary stripper 23, and a second conduit 37 for recirculating hot regenerated catalyst into upstream end 3 of riser conversion zone conduit 1, where it is mixed with hydrocarbon feed from feed source 7. Air distributor header 49 distributes air from conduit 59 to a bottom region of catalyst bed 45 in second stage regenerator 29.

Second stage regenerator 29 can include a cyclone system having a primary cyclone 39 and a secondary cyclone 41. The secondary cyclone includes dipleg 43 for fines removal from catalyst bed 45 of second stage regenerator 29.

The apparatus and process of the first embodiment of the present invention are particularly adapted for conversion of a thermofor catalytic cracking (TCC) system to fluid catalytic cracking operation. This is beneficial in that numerous thermofor catalytic cracking units are presently idle, while restarting in a thermofor catalytic cracking mode of operation being uneconomical. However, in many instances, conversion to fluid catalytic cracking operation by the method and apparatus of the present invention would be very economical.

Figure 2:
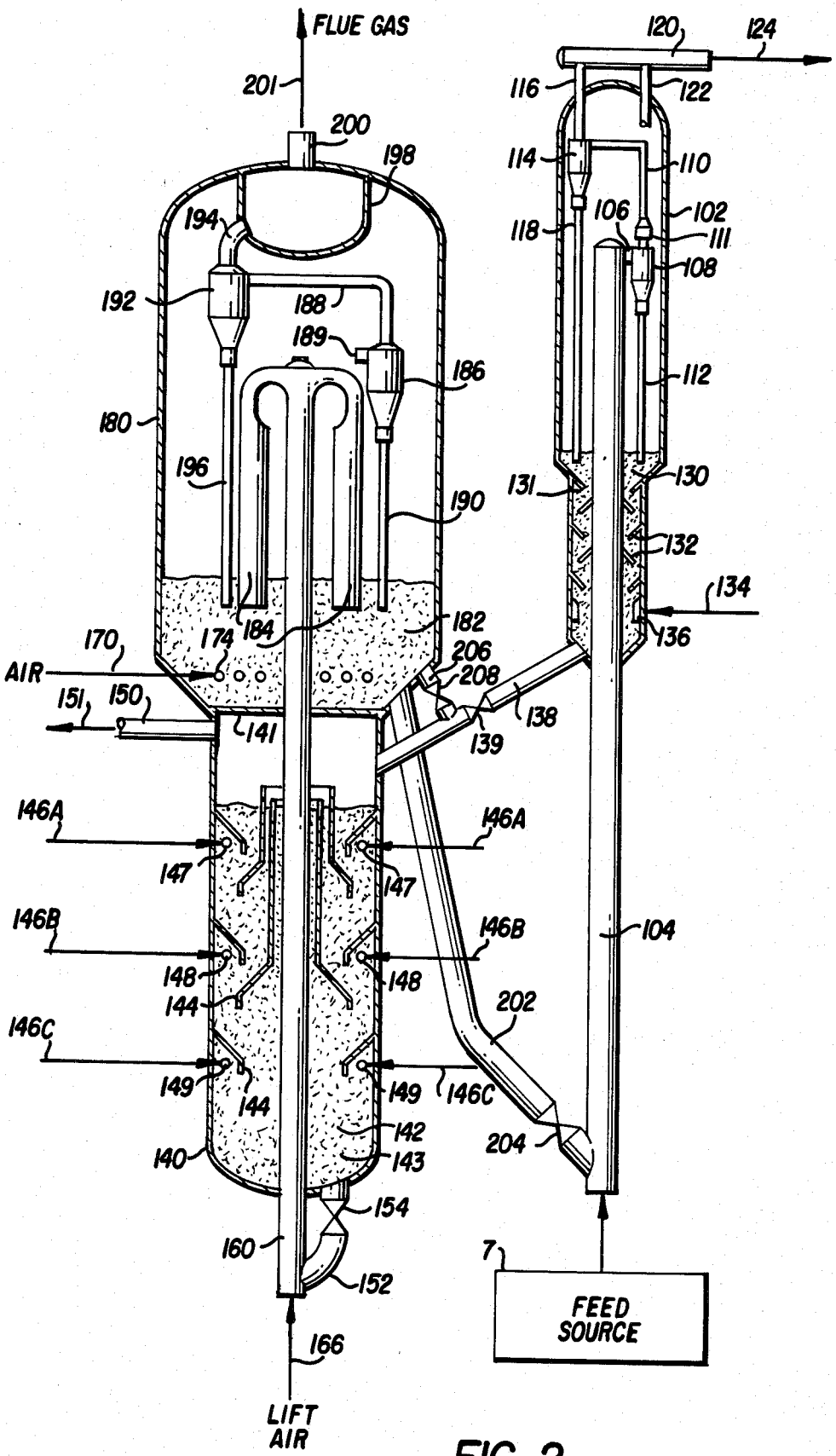
FIG. 2 illustrates a hot stripping vessel below the regenerator of the present invention.

FIG. 2 illustrates a second embodiment of a fluid catalytic cracking system of the present invention. In FIG. 2, a hydrocarbon feed passes from a hydrocarbon feed source (feeder) 7 to the lower end of a riser conversion zone 104 which is a vertically elongate tubular conduit. Regenerated catalyst from a standpipe 202, having a control valve 204, is combined with the hydrocarbon feed in the riser 104, such that a hydrocarbon-catalyst mixture rises in an ascending dispersed stream until it is discharged at a riser discharge temperature into a reactor vessel 102, and passes through a riser effluent conduit 106 into a first reactor cyclone 108. The riser discharge temperature, defined as the temperature at which the mixture is discharged from the riser 104 to conduit 106, may be any suitable temperature but preferably ranges from 900° to 1100° F., and most preferably 1000° to 1050° F. Riser effluent conduit 106 is attached at one end to the riser 104 and at its other end to the cyclone 108.

The first reactor cyclone 108 separates a portion of catalyst from the catalyst-hydrocarbon mixture and passes this catalyst down a first reactor cyclone dipleg 112 to a preliminary stripping zone 130 located therebelow. The remaining gas and catalyst pass from the first reactor cyclone 108 through a gas effluent conduit 110. The conduit 110 is provided with a connector 111 to allow for thermal expansion. The connector comprises overlapping portions of pipe and is described in detail in U.S. Pat. No. 4,502,947 to Hadded et al, which is incorporated herein by reference. The catalyst passes through the conduit 110, into a second reactor cyclone 114 as part of a closed cyclone system. The second cyclone 114 separates the stream to form a catalyst stream, which passes through a second reactor cyclone dipleg 118 to the preliminary stripping zone 130 located therebelow.

A second cyclone overhead stream, which contains the remaining gas and catalyst, passes through the second cyclone gaseous effluent conduit 116 to a reactor overhead port 120. It will be apparent to those skilled in the art that although only one series connection of cyclones 108, 114 is shown in the embodiment, more than one series connection and/or more or less than two consecutive cyclones in series connection would typically be employed. An additional series of cyclones (not shown) would be connected to conduit 122. Thus, the upflowing gases exit from the additional cyclone series through conduit 122.

The mixture of catalyst and hydrocarbons passes through the first reactor cyclone overhead conduit 110 to the second reactor cyclone 114 as part of a closed cyclone system without entering the reactor vessel 102 atmosphere. However, the connector 111 may provide an annular port to admit stripping gas from the reactor vessel 102 into the conduit 110 to aid in separating catalyst from hydrocarbons adhering thereto. The closed cyclone system and annular port is described more fully in U.S. Pat. No. 4,502,947 to Hadded et al, which is incorporated herein by reference.

The separated catalyst from cyclones 108, 114 pass through respective diplegs 112, 118 and are discharged therefrom after a suitable pressure is generated within the diplegs by the buildup of the catalyst. The catalyst falls from the diplegs into a bed of catalyst 131 located in the stripping zone 130. The first dipleg 112 and second dipleg 118 are sealed by being extended into the catalyst bed 131. However, diplegs 112, 118 could instead not extend into the catalyst bed 131, but be sealed by trickle valves (not shown).

The separated catalyst is passed to a preliminary stripping zone 130 where it is contacted with stripping gas. The stripping gas is introduced into the lower portion of the stripping zone 130 by one or more conduits 134 attached to a stripping gas header 136. The preliminary stripping zone 130 strips portions of coke, sulfur and hydrogen from the separated catalyst at conventional stripping conditions, such as temperature, pressure, gas residence time and solids residence time as known in the art.

The stripping zone 130 may also be provided with trays (baffles) 132. The trays 132 may be disc- and doughnut-shaped and may be perforated or unperforated.

The preliminary stripped catalyst passed from the zone 130 through a reactor effluent conduit 138 and combines with hot regenerated catalyst. The conduit 138 is provided with a valve 139. The regenerated catalyst has a temperature between 100° F. above that of catalyst 142 in a hot stripping zone 143 and 1600° F. to heat the preliminarily stripped catalyst. The regenerated catalyst passes from the regenerator 180 into the reactor effluent conduit 138 through a transfer line 206 attached at one end of the regenerator vessel 80 and at another end to the reactor effluent conduit 138. The transfer line 206 is provided with a slide valve 208.

Combining the separated catalyst with the regenerated catalyst heats the separated catalyst to promote subsequent hot stripping in the hot stripping zone 143 defined by a hot stripping vessel 140. The hot stripping occurs at a temperature between 100° F. above the riser exit temperature and 1500° F. Preferably, the catalyst in the hot stripping zone 143 has a temperature from 150° F. above the riser exit temperature to 1400° F. Most preferably, the hot catalyst stripping zone 143 has a temperature between 1100° and 1400° F.

The catalyst 142 in the hot stripping zone 143 is contacted at high temperature, discussed above, with a stripping gas, such as steam, flowing countercurrently to the direction of flow of the catalyst. The stripping gas is introduced into the lower portion of the hot stripping zone 143 by one or more conduits 146A, 146B, 146C, each attached to a stripping gas injection point 147, 148, 149, respectively. Conduit 146A preferably passes molecular nitrogen, molecular hydrogen, methane, ethane, propane or mixtures thereof into the hot stripping zone 143. Conduit 146C preferably passes molecular nitrogen, steam, or mixtures thereof into hot zone 143. The nitrogen and steam are fed to the lower portion of the hot stripping zone 143 to separate any hydrogen- or hydrocarbon-containing gas from the catalyst, thereby preventing hydrothermal degradation when the catalyst enters the regenerator riser 160 and contacts with oxygen.

The catalyst residence time in the hot stripping zone 143 ranges from 2.5 to 7 minutes. The vapor residence time in the hot stripping zone 143 ranges from 0.5 to 10 seconds, and preferably 0.5 to 5 seconds. The hot stripping zone 143 removes coke, sulfur and hydrogen from the separated catalyst which has been combined with the regenerated catalyst. The sulfur is removed as hydrogen sulfide and mercaptans. The hydrogen is removed as molecular hydrogen, hydrocarbons, and hydrogen sulfide. Preferably, the hot stripping zone 143 is maintained at desired conditions sufficient to reduce coke load to the regenerator by about 50% and strip away 70 to 80% of the hydrogen as molecular hydrogen, light hydrocarbons and other hydrogen-containing compounds. The hot stripping zone 143 is also preferably maintained at conditions sufficient to remove 45 to 55% of the sulfur as hydrogen sulfide and mercaptans, as well as a portion of nitrogen as ammonia and cyanides. The stripped hydrogen-, coke-, sulfur-and nitrogen-containing compounds pass from the hot stripping vessel through a gaseous effluent conduit 150, as a stream 151 which passes to a cyclone (not shown).

The hot stripping zone 143 may also be provided with trays (baffles) 144. The trays 144 may be disc- and doughnut-shaped and may be perforated or unperforated.

The hot stripping vessel 140 is located directly underneath the regenerator vessel 180. In the embodiment shown in FIG. 2, the hot stripping vessel 140 is attached to the regenerator vessel 180. The atmosphere of vessel 140 is separated from that of vessel 180 by a hot stripping vessel top wall 141. Locating vessel 140 below the vessel 180 results in an economical, long catalyst residence time hot stripper. It is cheaper to stack a long residence time hot stripper in this fashion than to build a separate vessel. It would also be more desirable to build a hot stripper under the regenerator than under the reactor vessel 102 for ease of catalyst circulation. The hot stripped catalyst passes from the hot stripping vessel 140 through an effluent conduit 152 and into a regenerator riser 160. Conduit 152 is attached to the hot stripping vessel 140 and riser 160 and provided with a slide valve 154.

In the regenerator riser 160, lift air from a conduit 166 and the hot stripped catalyst combine and pass upwardly as a dilute phase to the regenerator vessel 180. In the riser 160, combustible materials, such as coke which adheres to the cooled catalyst, are burned off the catalyst by contact with the air. The dilute phase passes upwardly through the riser 160, through a radial arm 184 attached to the riser 160, and then passes downwardly to a relatively dense bed of catalyst 182 located within the regenerator vessel 180.

The major portion of catalyst passes downwardly through the radial arms 184, while the gases and remaining catalyst pass into the atmosphere of the regenerator vessel 180. The gases and remaining catalyst then pass through an inlet conduit 189 into the first regenerator cyclone 186. The first cyclone 186 separates a portion of catalyst and passes it through a first dipleg 190, while remaining catalyst and gases pass through an overhead conduit 188 into a second regenerator cyclone 192. The second cyclone 192 separates a portion of catalyst and passes the separated portion through a second dipleg 196, with the remaining gas and catalyst passing through a second overhead conduit 194 into a regenerator vessel plenum chamber 198. A flue gas stream 201 exits from the regenerator plenum chamber 198 through a regenerator flue gas conduit 200.

The regenerated catalyst settles to form the bed 182, which is dense compared to the dilute catalyst passing through the riser 160. The regenerated catalyst bed 182 is at a substantially higher temperature than the stripped catalyst from the hot stripping zone 143, due to the coke burning which occurs in the riser 160 and regenerator 180. The catalyst in bed 182 is at least 100° F. hotter than the temperature of the catalyst 142 in the hot stripping zone 143, preferably at least 150° F. hotter than the temperature of the catalyst 142 in the hot stripping zone 143. The regenerator temperature is, at most, 1600° F. to prevent deactivating the catalyst.

Air also passes through an air transfer line 170, to an air header 174 located in the regenerator 180. This provides for additional regeneration in the regenerator 180. The regenerated catalyst then passes from the relatively dense bed 182 through the conduit 206 by gravity feed to conduit 138 to combine with and heat the catalyst from the preliminary stripping zone 130.

The preliminary stripping zone 130 is preferable, but optional. If desired, catalyst may pass from the reactor vessel 102 to the hot stripping zone 143 without preliminary stripping.

Figure 3:
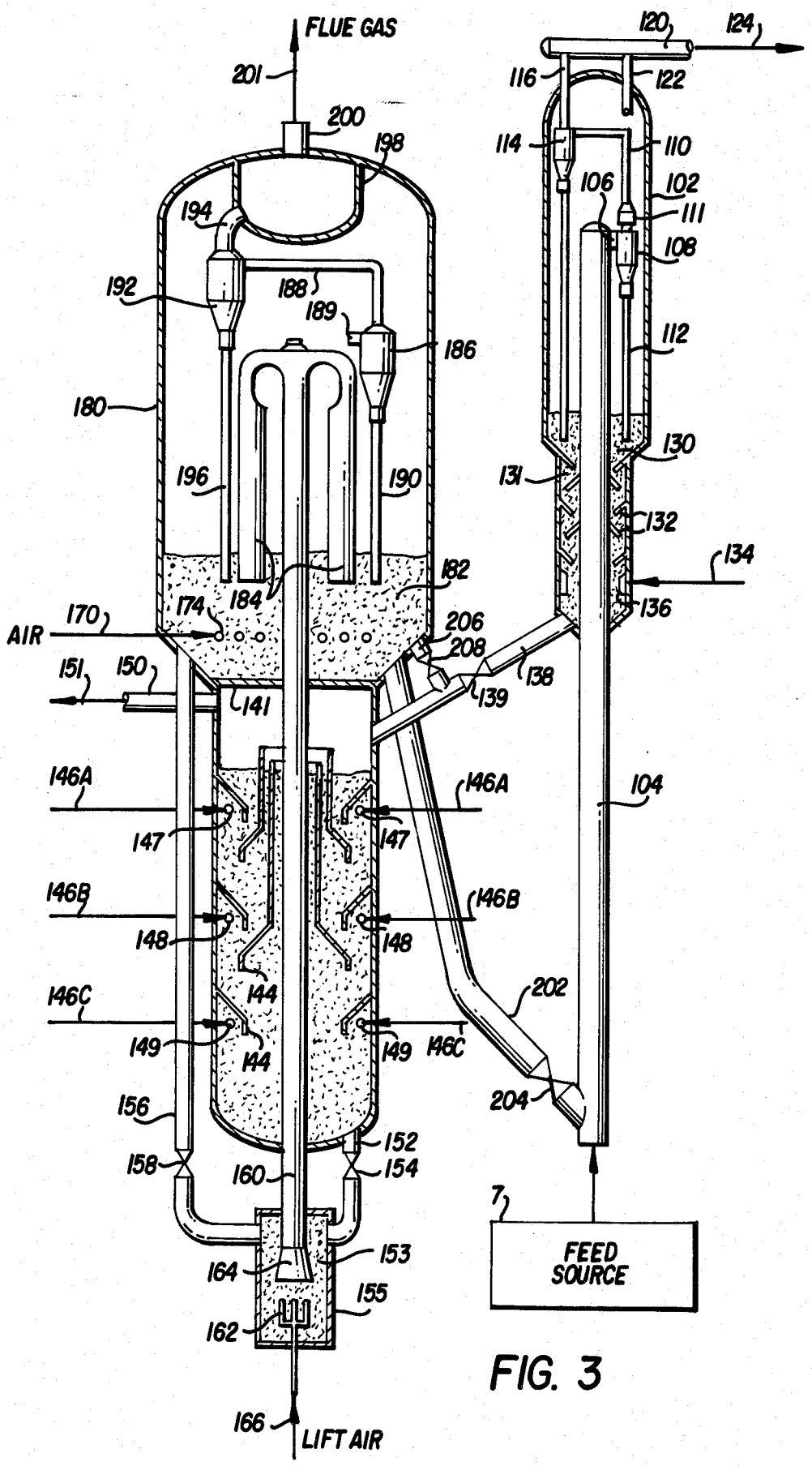
FIG. 3 illustrates the system of FIG. 2, further including a means for mixing hot stripped catalyst and regenerated catalyst.

FIG. 3 shows a third embodiment of the present invention. This third embodiment is an optional modification of the second embodiment of FIG. 2. In the embodiment shown on FIG. 3, if the temperature of the hot stripped catalyst from the conduit 152 is less than 1100° F., the hot stripped catalyst passes through the conduit 152 into a lift pot (preheat chamber) 155. A portion of hot regenerated catalyst passes through a conduit 156, provided with a control valve 158, into the lift pot 155. These catalyst streams form a catalyst bed 153. The air from a conduit 168 passes through a nozzle 162, fluidizes the catalyst in the bed 153, and subsequently transports the catalyst continuously as a dilute phase through the regenerator riser 160.

Any conventional fluid catalytic cracking catalyst can be used in the present invention. Use of zeolite catalysts in an amorphous base is preferred. Many suitable catalysts are discussed in U.S. Pat. No. 3,926,778 to Owen et al. The catalyst need not contain any agents designed to asborb or react with $SO_x$ in the fluid catalytic cracking regenerator.

Figure 4:
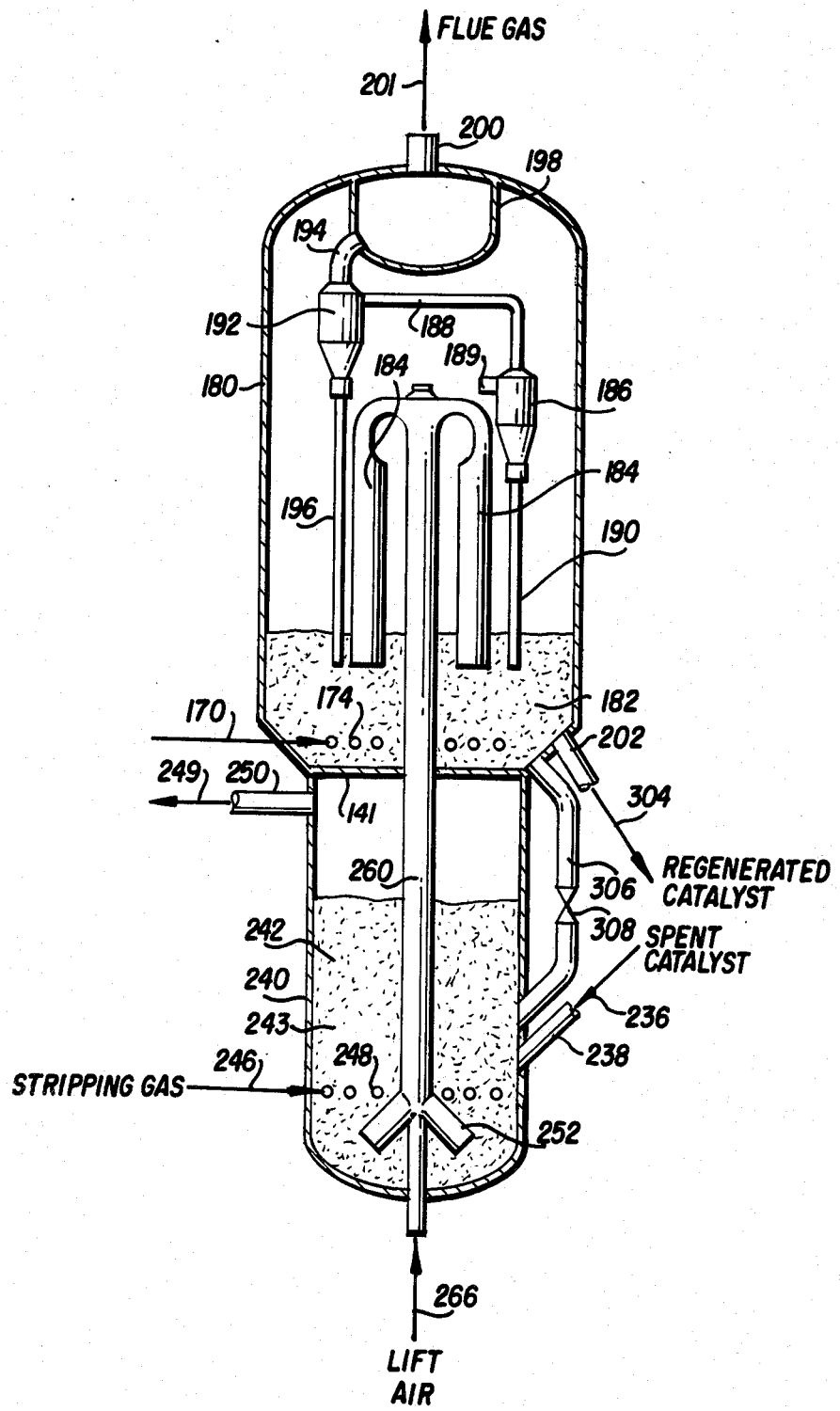
FIG. 4 illustrates a fluidized hot stripping vessel of the present invention.

In the fourth embodiment of the present invention, shown by FIG. 4, the countercurrent hot stripping zone 143, shown in FIGS. 2 and 3, is replaced by a fluidized bed hot stripping zone 243 contained within a hot stripping vessel 240. The hot stripping vessel 240 contains a fluidized, dense phase catalyst bed 242. A stream of spent catalyst 236 containing catalyst from the preliminary stripping zone 130 of FIG. 2 or separated catalyst taken directly from a fluid catalytic cracking reactor vessel without preliminary stripping, passes through a hot stripper inlet conduit 238 by gravity feed into the hot stripping vessel 240. The spent catalyst 236 is fluidized and stripped by contact with stripping gas provided by a stripping gas conduit 246 through injection points 248. Hot regenerated catalyst passes from the regenerator vessel 180 through a catalyst conduit 306, provided with a slide valve 308, into the hot stripping vessel 240 to mix with the spent catalyst.

In the hot stripping vessel 240 hydrogen-, sulfur-, and nitrogen-containing compounds are separated from the spent catalyst 236 and are discharged from the hot stripping vessel 240 as a gaseous effluent stream 249 through a gaseous effluent conduit 250. The stripped catalyst is discharged from the stripping vessel 240 by passing into a catalyst effluent conduit 252 where it combines with lift air provided by a conduit 266 and passes upwardly in dilute phase through a regenerator riser 260. The dilute phase catalyst then discharges from the regenerator riser 260 through radial arms 184 and is regenerated in the regenerator vessel 180, as described above for the embodiments shown by FIGS. 2 and 3. A regenerated catalyst stream 304 is discharged from the regenerator vessel 180 through the catalyst conduit 202 and passes to the riser conversion zone 104 (shown in FIG. 2).

The fluidized hot stripping zone 243 operates under the same ranges of temperature and gas residence time as the countercurrent stripping zone 143, shown in FIGS. 2 and 3.

Figure 5:
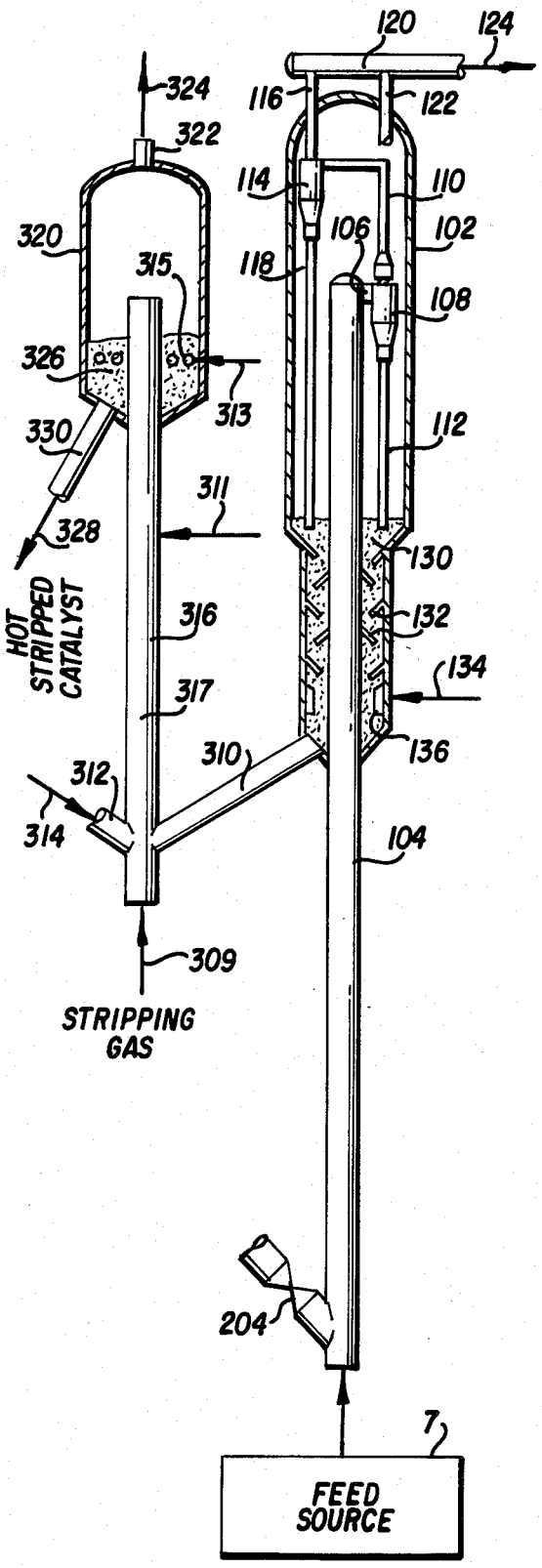
FIG. 5 illustrates a riser hot stripper of the present invention.

A fifth embodiment of the present invention, as shown by FIG. 5, employs the reactor vessel, as shown by FIGS. 2 and 3. However, catalyst passes from the preliminary stripping zone 130 through a preliminary stripper effluent conduit 310 into a hot stripping zone 317 comprising a hot stripping riser 316. In riser 316, the preliminary stripped catalyst from zone 130 combines with a first stripping gas stream 309 and a regenerated catalyst stream 314, which passes through a conduit 312 by gravity feed from a fluid catalytic cracking regenerator (not shown) into the hot stripping riser 316. The fluid catalytic cracking regenerator operates at the temperature conditions outlined for the fluid catalytic cracking regenerator 180 of FIGS. 2 and 3. These temperature conditions include a fluid catalytic cracking regenerator temperature between 100° F. above the temperature of catalyst in the hot stripping riser 316 and 1600° F., preferably a temperature between 150° F. above the temperature of catalyst in the hot stripping riser 316 and 1600° F.

The combined catalyst passes in dilute phase through the riser 316 for a gas residence time 0.5 to 10 seconds, and preferably 0.5 to 5 seconds. The combined catalyst is hot stripped in the riser 316 and is discharged from the riser 316 into a gas disengaging vessel 320. Optionally, the combined catalyst, in dilute phase, contacts with a second stripping gas stream 311 attached to a header (not shown) within the riser 316. Stream 311 contacts with the combined catalyst between 1 and 3 seconds after the combined catalyst initially contacts stream 309. Optionally, a third stripping gas stream 313 is injected into the disengaging vessel 320 at injection points 315 within the dense bed 326. Preferably, stream 309 comprises molecular nitrogen, molecular hydrogen, methane, ethane, propane or mixtures thereof, and stream 313 comprises steam, molecular nitrogen or mixtures thereof. Stream 311 may be any type stripping gas. In vessel 320, the gas continues upwardly and exits through a overhead conduit 322 as an overhead stream 324, while the solids drop downwardly to form a relatively dense bed of catalyst 326 in a lower portion of the vessel 320. The catalyst from the dense bed 326 then exits from the vessel 320 as a hot stripped catalyst stream 328, which passes through conduit 330 to a fluid catalytic cracking regenerator (not shown).

Figure 6:
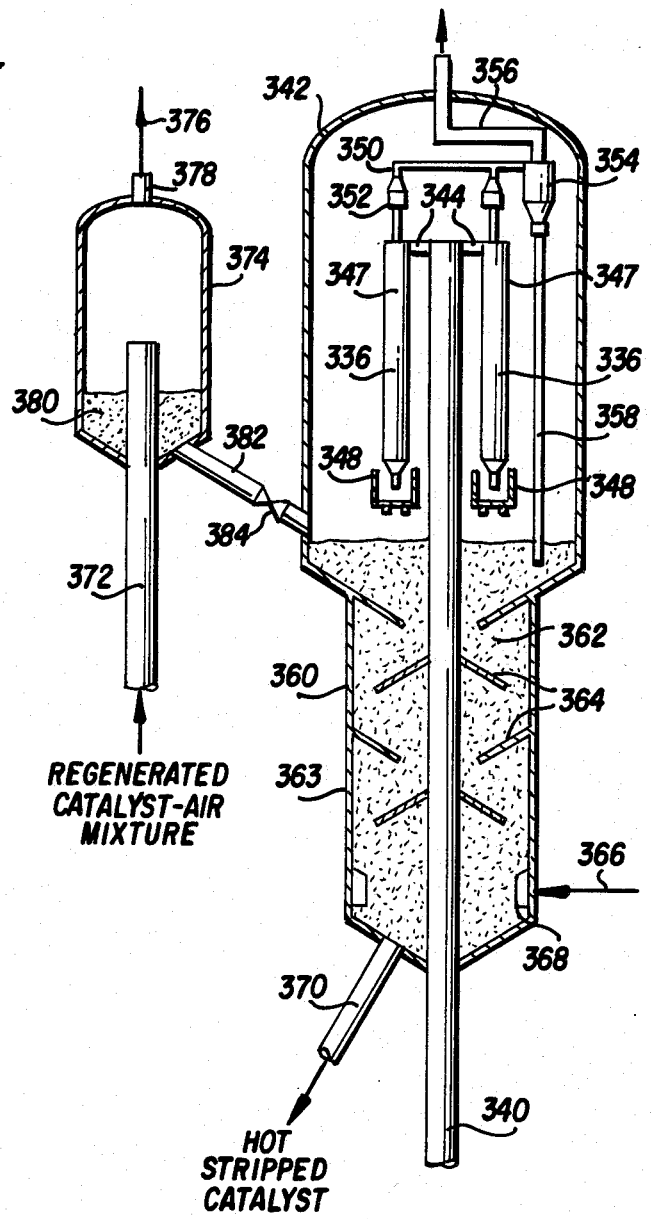
FIG. 6 illustrates a stripping vessel, seal pot and hot stripper located in a reactor vessel of the present invention.
Figure 7:
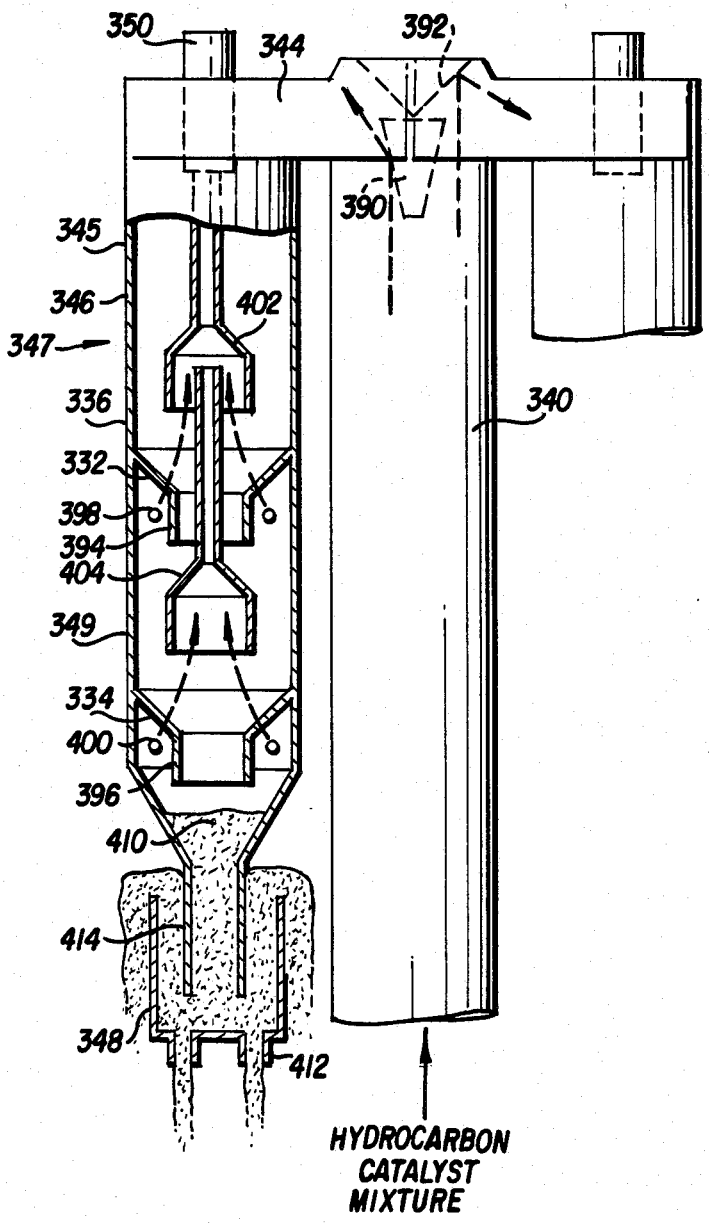
FIG. 7 illustrates details of the stripping vessel and seal pot of FIG. 6.

FIGS. 6 and 7 disclose a sixth embodiment of the present invention, in which preliminary stripping and catalyst separation occur in a reactor vessel 342. In this embodiment, a hydrocarbon-catalyst mixture passes through a riser conversion zone 340, at suitable catalytic cracking temperature conditions, as described for riser 104 discussed above. The mixture of catalyst and cracked hydrocarbons is deflected by a frusto-conical deflector 390, as shown by FIG. 7, attached to a conical deflector 392, and thus deflected through a conduit 344 into a cyclone portion 345 of a short contact time stripper 347. The cyclone 345 is a centrifugal separator. The short contact time stripper 347 includes a preliminary stripping vessel 349 which defines a preliminary stripping zone located adjacent a barrel 346 of the cyclone separator 345. This construction is such that extensions of the exit barrel walls 346 make up the walls of the preliminary stripping vessel 349. The preliminary stripping vessel 349 operates at preliminary stripping conditions, as discussed in regard to the previous embodiments.

FIG. 7 illustrates the details of the short contact time stripper 347. The hydrocarbon catalyst mixture ascends vertically through the riser conversion zone 340, and enters the cyclone 345 located in the upper portion of the short contact time stripper 347 and descends towards a lower portion thereof. Baffles 402 and 404 serve to direct the descending separated catalyst particles toward perforated conical diffusers 332 and 334. Steam is provided by inlets 398 and 400 and travels through only a portion of the flowing separated catalyst particles. The portion referred to is that catalyst located between the steam injection point and the intake of the baffles 402 and 404 which are inverted funnels. The steam does not flow through the catalyst particles above its associated funnel intake, therefore it does not place the hydrocarbon entrained therewith in further contact with catalyst. Although all catalyst is contacted with steam, a given amount of steam does not contact all catalyst contained thereabove in the stripping vessel 347.

The separated catalyst passes from the cyclone 345 to the baffle 404 through a conduit 394. The catalyst from the second conical diffuser 334 passes through a conduit 396 to a bed of catalyst 410 located therebelow. The catalyst in bed 410 is discharged from the short contact time stripping vessel 347 into an exit conduit 414 which is inserted into a seal pot 348. The catalyst exits the seal pot 348 by overflowing through an annulus between conduit 414 and the seal pot 348, as well as through drain holes 412 provided at the bottom of the seal pot 348. The drain holes 412 allow 10 to 90% of the catalyst to flow therethrough. The seal pot provides a catalyst seal, as opposed to extending the conduit 414 into a catalyst bed 362, shown in FIG. 6, located therebelow or providing the conduit 414 with a trickle valve.

As further seen in FIG. 6, the overhead from the short contact time stripper 347 passes through an overhead conduit 350 into a second cyclone 354, which separates a second portion of catalyst from the short contact time stripper overhead and passes the separated portion of catalyst through a dipleg 358 to catalyst bed 362 therebelow. The overhead conduit 350 may be provided with a connector 352, which may have an annulus for passing stripping gas from the vessel 32 into the conduit 350, as described above in relation to connector 24 of FIGS. 2 and 3.

Catalyst from the seal pot 348 passes to the catalyst bed 362 located in a hot stripping zone 363, defined by the lower portion 360 of the reactor vessel 342.

In the hot stripping zone 363, the preliminarily stripped catalyst from the seal pot 348 combines with hot regenerated catalyst from conduit 382. The conduit 382 is provided with a slide valve 384. The regenerated catalyst is provided by passing a regenerated catalyst air mixture upwardly through a riser 372, which discharges the regenerated catalyst air mixture into a disengaging vessel 374. Gasiformed material continues upwardly and exits vessel 374 through an overhead conduit 378 as an overhead stream 376. Solids separated from the regenerated catalyst air mixture drop through the vessel 374 to form a dense catalyst bed 380. The regenerated catalyst from bed 380 passes through the conduit 382 by gravity feed into the reactor vessel 342, at the temperature conditions between 100° F. above that of the catalyst in the hot stripping zone 363 and 1600° F., preferably between 150° F. above that of the catalyst in zone 363 and 1600° F. The regenerated catalyst from the conduit 382 provides heat to the hot stripping zone 363.

The combined catalyst within the lower portion 360 of the reactor vessel 342 passes countercurrently to stripping gas provided by a stripping gas conduit 366, which feeds a stripping gas header 368. Optionally, additional stripping gas conduits and injection points are provided, as in the hot stripping zone 143 of FIGS. 2 and 3. The hot stripping zone 363 may be provided with baffles (trays) 364 which are disc- and doughnut-shaped and may be perforated or unperforated. The hot stripped catalyst is discharged from the hot stripping zone 363 through a conduit 370 and passes to a fluid catalytic cracking regenerator (not shown).

Operating the stripping zone as a high temperature (hot) stripper has the advantage that it separates hydrogen, as molecular hydrogen as well as hydrocarbons, from catalyst. Hydrogen removal eliminates hydrothermal degradation, which typically occurs when hydrogen reacts with oxygen in a fluid catalytic cracking regenerator to form water. The hot stripper also removes sulfur from coked catalyst as hydrogen sulfide and mercaptans, which are easy to scrub. By removing sulfur from coked catalyst in the hot stripper, the hot stripper prevents formation of $SO_x$ in the regenerator. It is more difficult to remove $SO_x$ from regenerator flue gas than to remove hydrogen sulfide and mercaptans from a hot stripper effluent. The hot stripper enhances removal of hydrocarbons from spent catalyst, and thus prevents burning of valuable hydrocarbons in the regenerator. Furthermore, the hot stripper quickly separates hydrocarbons from catalyst to avoid overcracking.

Preferably, the hot stripper is maintained at desired conditions sufficient to reduce coke load to the regenerator by about 50%, and strip away 70 to 80% of the hydrogen as molecular hydrogen, light hydrocarbons and other hydrogen-containing compounds. The hot stripper is also maintained at conditions sufficient to remove 45 to 55% of the sulfur as hydrogen sulfide and mercaptans, as well as a portion of nitrogen as ammonia and cyanides.

The hot stripper controls the amount of carbon removed from the catalyst in the stripper. Accordingly, the hot stripper controls the amount of carbon (and hydrogen, sulfur) remaining on the catalyst to the regenerator. This residual carbon level controls the temperature rise between the reactor stripper and the regenerator. The hot stripper also controls the hydrogen content of the spent catalyst sent to the regenerator as a function of residual carbon. Thus, the hot stripper controls the temperature and amount of hydrothermal deactivation of catalyst in the regenerator. This concept may be practiced in a multistage, multi-temperature stripper or a single stage stripper.

The degree of regeneration desired is set by the $CO/CO_2$ ratio desired, the amount of carbon burn-off desired, the catalyst recirculation rate from the regenerator to the hot stripper, and the degree of desurfurization/denitrification/decarbonization desired in the hot stripper.

Employing a hot stripper to remove carbon on the catalyst, rather than a regeneration stage, reduces air pollution, and allows all of the carbon made in the reaction to be burned to $CO_2$, if desired.

Thus, the embodiment of the invention, shown in FIG. 1, provides for two-stage hot stripping to reduce hydrogen, sulfur and carbon levels to a fluid catalytic cracking regenerator. It also has the advantage that it allows for converting a TCC unit to an FCC unit with maximum use of the TCC unit. The embodiment of FIG. 2 provides for a single stage hot stripper or a first stage preliminary stripper followed by a second stage hot stripper. Furthermore, it provides a second stage hot stripper which employs short gas contact time (0.5 to 10 seconds, preferably 0.5 to 5 seconds) to quickly separate hydrocarbons from catalyst to prevent overcracking. It also provides for injection of different stripping gases into the upper and lower parts, respectively, of the hot stripper. The embodiment of FIG. 3 allows regenerated catalyst to combine with hot stripped catalyst to heat the hot stripped catalyst. FIG. 4 shows a fluid bed hot stripper. The embodiments shown by FIGS. 2–4 all stack a regenerator vessel above a hot stripping vessel. This stacking results in an economical design and facilitates catalyst flow into the regenerator. FIG. 5 shows a riser employed to hot strip catalyst. FIGS. 6 and 7 show a preliminary stripping zone and hot stripping zone, both located in a reactor vessel. This is particularly useful to retrofit existing reactor vessels.

The above-described descriptions, and the accompanying drawings, are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

We claim:

1. A process for fluid catalytic cracking of a hydrocarbon feedstock, comprising:

passing a cracking catalyst and feedstock upwardly through a riser conversion zone under fluid catalytic cracking conditions to crack the feedstock and form a mixture of cracking products and catalyst, discharging said mixture at a discharge temperature from the riser;

centrifugally separating catalyst from the mixture of cracking products and catalyst, stripping the separated catalyst by contacting it with a stream of stripping gas in a confined preliminary stripping zone, combining the stripping gas from the preliminary stripping zone with the cracking products and passing them to an exit of the preliminary stripping zone, heating the stripped catalyst from the preliminary stripping zone by combining it with regenerated catalyst from a fluid catalytic cracking catalyst regenerator vessel to form combined catalyst, hot stripping the combined catalyst by contact with a stream of stripping gas in a hot stripping zone at a hot stripping temperature between 100° F. above said discharge temperature and 1500° F., the regenerated catalyst having a temperature between 100° F. above the hot stripping temperature and 1600° F., to form hot stripped catalyst and a stream of stripping gas and stripped hydrocarbons, combining the stream of stripping gas and stripped hydrocarbons from the hot stripping zone with the combined stream from the preliminary stripping zone outside the preliminary stripping zone, and regenerating the hot stripped catalyst in a regenerator by contact with an oxygen-containing stream at regeneration conditions including a temperature in the range from 100° F. above that of the hot stripping temperature to 1600° F.

2. The process of claim 1, wherein said feedstock includes sulfur-containing compounds, said hot stripping zone produces a hot stripper gaseous stream comprising stripping gas, hydrocarbons and sulfur-containing compounds derived from components of said feedstock.

3. The process of claim 2, wherein said mixture discharges from said riser conversion zone at a discharge temperature between 1000° and 1050° F., and said regenerator conditions comprise a temperature between 150° F. above said hot stripping temperature and 1600° F.

4. The process of claim 3, wherein said catalyst in said hot stripping zone has a hot stripping temperature between 150° F. above said riser discharge temperature and 1400° F. and said hot stripper gaseous stream has a residence time from 0.5 to 5 seconds in said hot stripping zone.

5. The process of claim 4, wherein said first separator catalyst portion of said combined catalyst comprises said sulfur-containing compounds and hydrocarbons derived from said feedstock, and said stripping zone removes 45 to 55% of said sulfur-containing compounds and 70 to 80% of hydrogen from said hydrocarbons in said separated catalyst portion.

6. The process of claim 2 wherein said gaseous stream has a residence time of 0.5 to 10 seconds in said hot stripping zone.

7. The process of claim 6, wherein said separating step comprises downwardly deflecting catalyst in said mixture discharged from said riser by contact with a catalyst deflector to said preliminary stripping zone, with a remainder forming said separator gaseous effluent stream, further comprising the step of separating in a cyclone a second portion of separated catalyst from said separator gaseous effluent stream and passing said second portion of separated catalyst to said hot stripping zone.

8. The process of claim 7, wherein said catalyst from said hot stripping zone passes into a first stage regeneration zone of said regenerator, and partially regenerated catalyst discharges from the first stage regeneration zone into a second stage regeneration zone, which discharges regenerated catalyst into said hot stripping zone and into an upstream end of said riser conversion zone.

9. The process of claim 8, wherein said hot stripping vessel is located below said regenerator vessel and outside said reactor vessel, and said hot stripped catalyst along with a second oxygen-containing stream passes through a regenerator riser to said regenerator vessel.

10. The process of claim 9, wherein said preliminarily stripped catalyst and said first portion of regenerated catalyst are combined outside of said reactor vessel to form said combined catalyst, and said combined catalyst is passed into said hot stripping vessel.

11. The process of claim 9, wherein said preliminarily stripped catalyst and said regenerated catalyst portion are combined in said hot stripping vessel.

12. The process of claim 9, wherein said mixture from said riser conversion zone is separated in said separating step by a closed cyclone system in communication with said riser conversion zone.

13. The process of claim 12, wherein said catalyst in said hot stripping vessel passes countercurrently to said first stripping gas.

14. The process of claim 13, wherein a second portion of regenerated catalyst and said hot stripped catalyst are combined prior to passing into said regenerator.

15. The process of claim 6, wherein said preliminarily stripped catalyst combines with said first portion of regenerated catalyst and said first stripping gas stream to form said combined catalyst and said hot stripping step comprises passing said combined catalyst up a hot stripping riser, and discharging said combined catalyst from said hot stripping riser and separating said discharged catalyst to form said hot stripped catalyst and a gaseous stream.

16. The process of claim 15, wherein said discharged catalyst contacts a fourth stripping gas, consisting essentially of a member of the group consisting of molecular nitrogen and steam.

17. The process of claim 16, wherein a second stripping gas, consisting essentially of a member of the group consisting of molecular nitrogen and steam, contacts said combined catalyst in said hot stripping riser between 1 and 3 seconds after said combined catalyst contacts said first stripping gas.

18. The process of claim 2, wherein said hot stripping vessel is located below said regenerator vessel and outside said reactor vessel, and said hot stripped catalyst passes upwardly through a regenerator riser to said regenerator vessel.

19. The process of claim 6, wherein said third stripping gas is steam.

20. A method of fluid catalytically cracking a hydrocarbon feed with a catalyst in a riser conversion zone and subsequently regenerating catalyst recovered from said riser conversion zone to heat said catalyst to remove carbonaceous deposits before returning to said riser conversion zone, comprising:

(a) introducing hydrocarbon feed and catalyst into an upstream end of a riser conversion zone to yield a gasiform mixture of catalyst and cracked hydrocarbons exiting a downstream end of said riser conversion zone, said riser conversion zone comprising a vertically elongate tubular conduit;

(b) deflecting catalyst in said mixture exiting said downstream end of said riser conversion zone downwardly to a primary stripping zone to separate a portion of said catalyst from said cracked hydrocarbons;

(c) contacting said downwardly deflected catalyst with a stripping medium introduced into said primary stripping zone to separate said downwardly deflected catalyst from hydrocarbons and form a first stream of stripping gas and stripped hydrocarbons;

(d) separating in a cyclone separator a portion of said catalyst which was not deflected downwardly in step (b) from said cracked hydrocarbons;

(e) introducing stripped catalyst from said primary stripping zone and catalyst from a dipleg of said cyclone separator directly into a secondary stripping zone;

(f) passing stripped catalyst from said secondary stripping zone directly into a first stage regenerator;

(g) introducing regenerated catalyst output from said first stage regenerator into a second stage regenerator; and (h) recycling hot regenerated catalyst from said second stage regenerator directly into said secondary stripping zone to maintain the secondary stripping zone at a temperature above that of the stripped catalyst from the primary stripping zone and to form a second stream of secondary stripping gas and stripped hydrocarbons removed from the catalyst in the secondary stripping zone, (i) combining the first and second streams of stripping gas and stripped hydrocarbons outside the primary stripping zone.

21. The method of claim 20, wherein catalyst from said primary stripper, catalyst from said cyclone dipleg and hot regenerated catalyst from said second stage regenerator are mixed prior to being introduced into said secondary stripping zone.

22. The method of claim 20, wherein said first stage regenerator is a fast fluidized bed regenerator and said second stage regenerator is a dense-bed combustion zone, and wherein said catalyst which is passed into said first stage regenerator in step (f) is contacted with combustion air in said first stage regenerator, and said catalyst which is introduced into said second stage regenerator in step (g) is contacted with combustion air in said second stage regenerator.

23. The method of claim 20, further comprising removing fines from a catalyst bed in said second stage regenerator using cyclone means comprising a primary cyclone and a secondary cyclone, said secondary cyclone including a secondary dipleg for removing said fines.

24. The method of claim 20, further comprising introducing a stripping medium into said secondary stripping zone to contact catalyst to separate said catalyst from hydrocarbon entrained therein, and introducing hot regenerated catalyst from said second stage regenerator into said upstream end of said riser conversion zone.

25. The method of claim 20, wherein said cyclone separator is external to said riser conversion zone.

26. The method of claim 20, wherein steps 66(b), (c), (d), and (e) occur in a thermofor catalytic cracking unit retrofitted to accommodate said fluid catalytic cracking method.

27. A process for fluid catalytic cracking of a feedstock containing hydrocarbons, comprising the steps of:

passing a mixture comprising catalyst and said feedstock upwardly through a riser conversion zone under fluid catalytic cracking conditions to crack said feedstock, said riser terminating in a reactor vessel;

discharging said mixture, having a discharge temperature between 900° and 1100° F., from said riser;

cyclonically separating a first portion of catalyst from said mixture in a centrifugal separator, with a remainder of said mixture forming a separator gaseous effluent stream, immediately passing said first portion of separated catalyst from said centrifugal separator to a preliminary stripping zone, said preliminary stripping zone being defined by a preliminary stripping vessel attached to said centrifugal separator and located below said centrifugal separator, said preliminary stripping vessel having an entrance, a catalyst exit, and an exit for passing stripped hydrocarbons through said centrifugal separator;

non-cyclonically stripping said first separated catalyst by injecting a first stripping gas into said preliminary stripping vessel at an injection location for exposure to a portion of said first portion of separated catalyst located above said injection location after said first portion of separated catalyst has been centrifugally separated from said gaseous effluent stream;

passing said first stripping gas, and hydrocarbons stripped from said separated catalyst, directly to said stripped hydrocarbon exit as said separator gaseous effluent stream without contacting a remainder of said first portion of separated catalyst;

heating said separated catalyst portion by combining said first separated catalyst portion with a first portion of regenerated catalyst from a fluid catalytic cracking regenerator vessel to form combined catalyst;

gravity feeding said first portion of regenerated catalyst into a hot stripping zone;

hot stripping said combined catalyst by contact with a second stripping gas stream, in said hot stripping zone to form a hot stripped catalyst stream and a hot stripper gaseous stream, at a hot stripping temperature between 100° F. above said discharge temperature and 1500° F., said first regenerated catalyst portion having a temperature between 100° F. above said hot stripping temperature and 1600° F. prior to heating said separated catalyst, wherein said hot stripper gaseous stream has a residence time of 0.5 to 10 seconds in said hot stripping zone; and regenerating said hot stripped catalyst in a fluid catalytic cracking regenerator vessel by contact with an oxygen-containing stream at fluid catalytic cracking regeneration conditions, comprising a temperature in the range from 100° F. above that of said hot stripping temperature to 1600° F.

28. The process of claim 27, wherein said second stripping gas is selected from the group consisting of molecular nitrogen, molecular hydrogen, methane, ethane, and propane.

* * * * *